US006619506B2

(12) United States Patent
Famiglietti

(10) Patent No.: US 6,619,506 B2
(45) Date of Patent: Sep. 16, 2003

(54) MORTAR APPLICATOR AND METHOD THEREFOR

(76) Inventor: Angelo Famiglietti, 27 Devine Rd., Suffield, CT (US) 06078

( * ) Notice: Subject to any disclaimer, the term of this patent is extended or adjusted under 35 U.S.C. 154(b) by 0 days.

(21) Appl. No.: 10/003,207

(22) Filed: Oct. 30, 2001

(65) Prior Publication Data

US 2003/0080149 A1 May 1, 2003

(51) Int. Cl.[7] ..... B65D 35/00

(52) U.S. Cl. ..... 222/99; 222/103; 383/41; 383/906

(58) Field of Search ..... 222/99, 103; 383/41, 383/906

(56) References Cited

U.S. PATENT DOCUMENTS 2,545,773 A * 3/1951 Gonzalez ..... 222/99
2,903,162 A * 9/1959 Regan ..... 222/99
3,138,821 A * 6/1964 Macciocchi et al. ..... 222/567
5,090,597 A * 2/1992 Johnson ..... 222/107
5,497,913 A * 3/1996 Baker ..... 222/102

* cited by examiner

*Primary Examiner*—J. Casimer Jacyna
(74) *Attorney, Agent, or Firm*—McCormick, Paulding & Huber LLP

(57) ABSTRACT

The invention disclosed is an actuator for use with a bag having two openings therein wherein the actuator seals one opening and assists in forcing the flowable substance out of the bag. The actuator is demonstrated with a generally conically shaped bag used with mortar such as masonry cement. The bag provides method for applying a continuous constant pressure to the bag thereby forcing the mortar out in a continuous and constant flow.

2 Claims, 2 Drawing Sheets

MORTAR APPLICATOR AND METHOD THEREFOR

FIELD OF THE INVENTION

The present invention is a tool and a method for use of the tool to assist in the application of a flowable substance and more specifically, is an actuator for sealing a bag into which the flowable substance is placed to assist in forcing the flowable substance therefrom.

BACKGROUND OF THE INVENTION

Flowable substances such as mortar are used to fill gaps such as between bricks in a facade. For example in the case of a brick facade that is being built or subsequently pointed, the gap must have mortar, or more particularly masonry cement, forced into the gap to the width of the brick. Generally, the process of filing the gap involves using a trowel to push mortar off a mortarboard into the gap. This process is labor intensive utilizing highly skilled labor and is extremely time consuming.

In addition, as the mortar is pushed into the gap, it is inevitable that some mortar will spill over onto the face of the brick, i.e. a finished surface of the brick that is viewed. Removal of the mortar from the face can be difficult sometimes involving an acid and potentially damaging to the brick as well as the mortar. This cleaning process is not only potentially dangerous but also expensive.

New brick products developed for architectural applications also have gaps that must be filled with mortar. Facade brick mounted on a sheet are one example. Sheet mounted facade brick comprises some number of brick faces, i.e. thin bricks, mounted on a single sheet with proper spacing. Installation of the product involves mounting the sheet to a surface and filling the gaps between the brick faces with mortar. The finished surface is therefore an actual brick face and mortar, and the finished surface cannot be distinguished from a normal brick facade. The placement of the mortar within the gaps has the associated problems discussed above.

Bags have been developed for pushing mortar into gaps. The bags are shaped like a frustum of a cone, i.e. conical with a large opening at one end tapering to small opening at the other end. Mortar is placed in the bag through the large opening and the large opening is folded; e.g., twisted, etc. The folding of the bag simultaneously seals the large opening and puts pressure on the mortar in the bag forcing the mortar to exit the bag through the small opening. As those who have ever used such a bag can attest, forcing the material from the bag requires considerable strength, and it can be difficult to control the outflow of the flowable substance through the small opening.

Based on the foregoing, it is an objective of the present invention to provide a tool and a method of use to overcome the problems associated with the prior art.

SUMMARY OF THE INVENTION

The invention is an actuator that facilitates the use of a bag having two openings into which a flowable substance can be placed. More specifically, the actuator is placed across the bag clamping one of the openings shut after which the actuator is progressively rotated whereby the bag rolls up about the actuator putting pressure on the flowable substance therein such that it is forced out of the bag through the other opening. The actuator includes a base that has a body with a handle that has a shape that permits a torque, i.e. leverage, to be applied to the body. The leverage gives a mechanical advantage during rolling to assist in rotating the actuator thereby giving a more continuous and constant pressure on the flowable substance therein for a uniform flow of the flowable substance through the other opening. An arm is attached to the base by a hinge such that the arm and base can be placed generally parallel one to the other and define a slot. The arm is secured to the base by a clasp. In one embodiment, the arm and body are hinged at one end and the clasp secures the other end of the arm to the other end of the body. In this embodiment, the arm, body, and clasp define the slot.

In a mortar applicator, a bag is placed in the slot of the actuator. The bag, which has a large and a small opening and mortar therein, is placed in the actuator such that the actuator clamps shut the large opening of the bag effectively trapping the mortar in the bag between the actuator and the small opening. The bag is designed to hold mortar and the actuator should clamp the bag sufficiently to prevent the mortar from exiting the bag through the large opening. In the preferred embodiment, the bag would only be partially filled such that the actuator could be placed on the bag and rotated through at least one revolution prior to exerting any pressure on the mortar. Therefore, the sealing of the bag to prevent the mortar from exiting the bag through the large opening could be accomplished by the actuator cooperating with the bag folded about it.

It is preferred, but not required, that the bag be conical shaped with two openings making the bag a frustum of cone. The size of the cone as well as the openings is application dependent.

The slot of the actuator should be sufficient to accommodate the entire bag where the clamp is to be placed on the bag. The actuator is advantageously placed perpendicular to the longitudinal axis of the bag. Further, it is preferred that the slot be at least as long as the bag is wide. For a frustum of cone bag, the width of the bag is the distance across the large opening when the bag is laid flat. This will assure that when the bag is rolled around the actuator all of the contents of the bag will receive uniform pressure.

In the method of using the mortar applicator, a bag is obtained having a large and small opening. Mortar is placed in the bag through the large opening and then the large opening is sealed with the actuator. The actuator is then rotated thereby rolling the bag up around the actuator. As the bag is rolled up, pressure is exerted on the mortar therein forcing the mortar to exit the bag through the small opening.

While the present invention has been discussed in the context of mortar, any flowable substance such cement, grout, or plaster could be used. It should be remembered, however, that the viscosity of the flowable substance is application dependent and ideally the viscosity of the flowable substance should be such that the substance is generally forced from the bag as opposed to naturally flows out of the bag, if conditions permitted it.

DETAILED DESCRIPTION OF THE INVENTION

Figure 1:
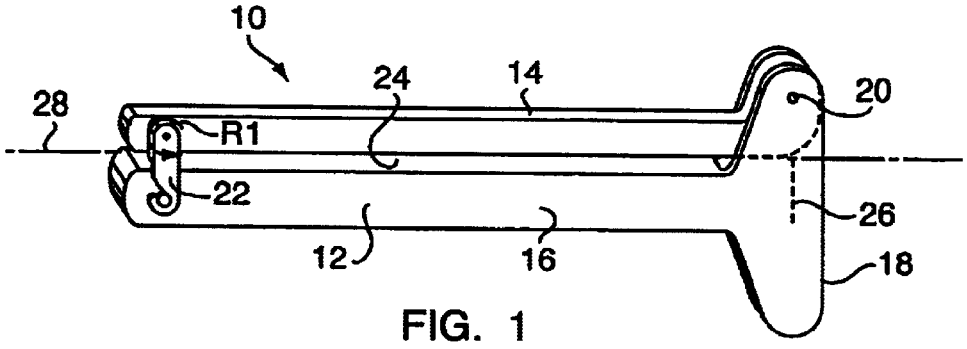
FIG. 1 is a perspective view of the actuator of the present invention.

As shown in FIG. 1 the actuator generally referred to by reference number 10 is comprised of a base 12 hingeably connected to an arm 14. The base 12 includes a body 16 coupled to a handle 18. The hinge 20 is integrated into the handle 18. The body 16 and the arm 14 are held together by a clasp 22, and the body 16, the arm 14, and the clasp 22 cooperate to define a slot 24. The handle 18 is shaped such that a moment arm 26 (depicted with dotted lines) is created about a rotational axis 28 thereby permitting a torque to be applied to the actuator 10. The clasp 22 is an L-shaped body that is pivotally connected to the body 16 and rotates as indicated by the arrow R1.

The moment arm 26 permits a mechanical advantage in rotating the actuator 10. This mechanical advantage reduces the overall force that must be applied thereby allowing for a more consistent and uniform flow of the flowable substance from a bag, discussed blow.

Figure 2:
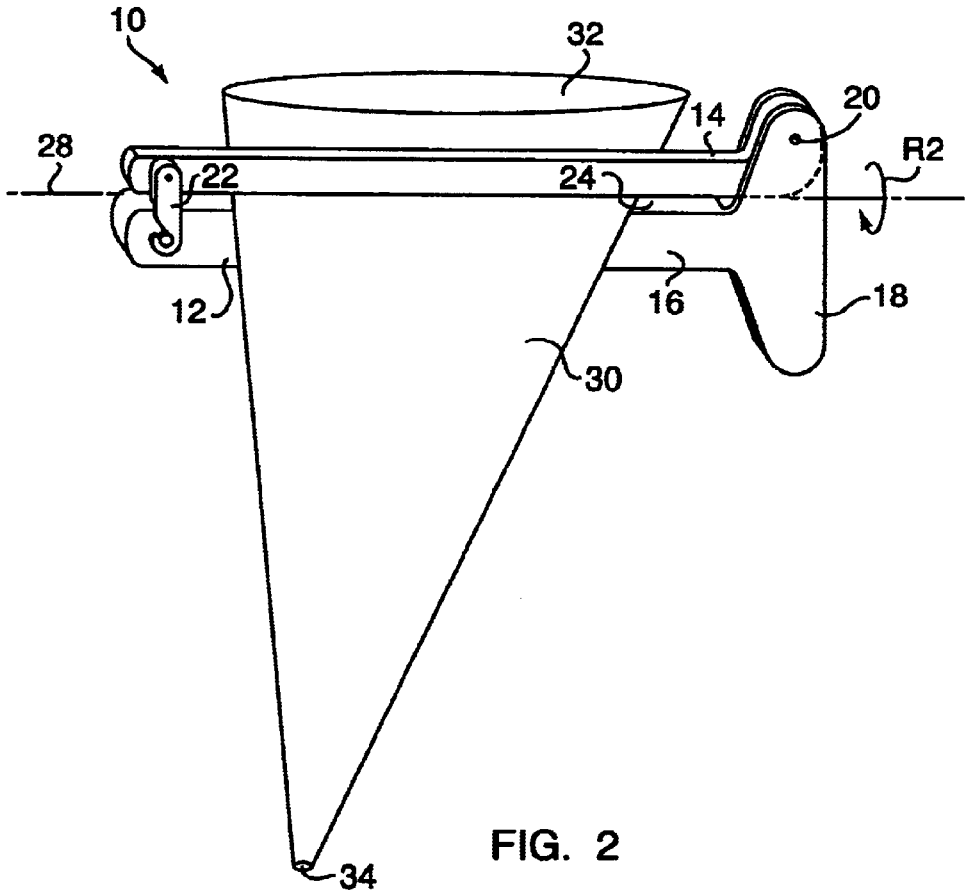
FIG. 2 is a perspective view of the actuator of FIG. 1 with a bag positioned therein.

In FIG. 2, a bag 30 has been placed in the slot 24 of the actuator 10. The bag 30 is conically shaped having a large opening 32 and a small opening 34. In use, a flowable substance (not shown) would be placed in the bag 30 through the large opening 32 and the actuator 10 would secure the flowable substance in the bag 30, i.e. prevent the flowable substance from exiting the bag 30 through the large opening 32. The slot 24 is sized to clamp the bag 30 thereby sealing the large opening 32. The seal is not a hermitic, but is sufficient to prevent the back flow of the flowable substance in the bag 30. In sealing the bag 30 it must be remembered that the bag 30 rotates about actuator 10 (see FIG. 3) in operation. The folding of the bag 30 resulting from the rotation can assist in sealing the bag 30, therefore, the seal provided by the actuator 10 could be minimal.

The slot 24 of the actuator 10 should be sufficient to accommodate the entire bag 30 where the actuator 10 is to be placed. The actuator 10 is advantageously placed perpendicular to the longitudinal axis of the bag 30. Further, it is preferred that the slot 24 be at least as long as the bag 30 is wide. For a conical bag 30, the width of the bag 30 is the distance across the large opening 32 when the bag 30 is laid flat. This will assure that when the bag 30 is rolled around the actuator 10, all of the contents of the bag 30 receives uniform pressure.

Figure 3:
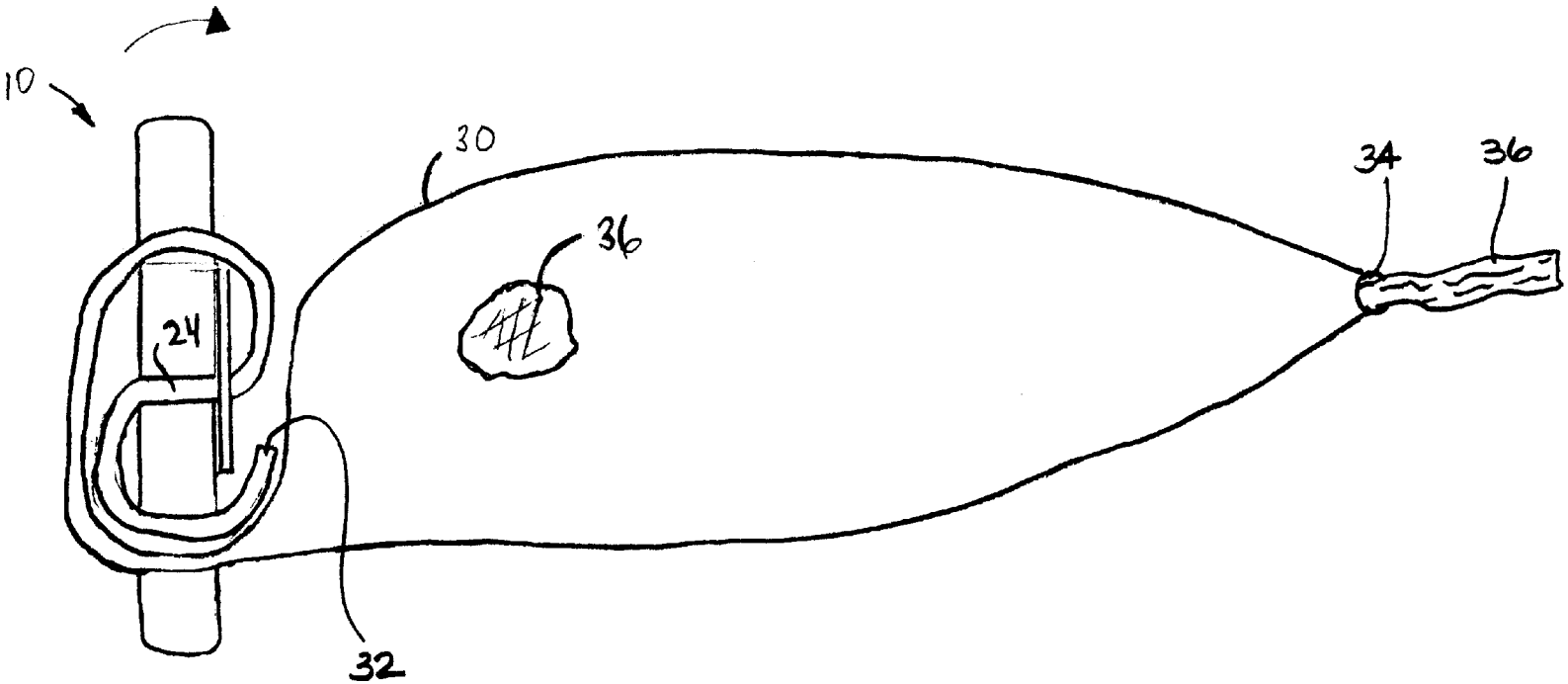
FIG. 3 is a side view of the actuator and bag of FIG. 2 with a flowable substance in the bag and the actuator rotated one revolution.

Continuing with FIG. 3, a flowable substance 36 is positioned within the bag 30, and the bag 30 is positioned in the slot 24. In this figure, the actuator 10 has been rotated one revolution about a rotational axis R2 such that the actuator 10 is putting pressure on the flowable substance 36 such that the flowable substance 36 is forced out through the smaller opening 34. It is important that the smaller opening 34 be sized appropriately. The flowable substance 36 will have a viscosity. The smaller opening 34 should be sized considering the viscosity such that the flowable substance 36 is generally retained in the bag 30 even through the smaller opening 34 is positioned at a point below the flowable substance 36, i.e. the flowable substance 36 should be generally forced out of the bag 30 and not merely flow out.

It is preferred that the bag 30 is a frustum of cone. The size of the cone and the openings therein are application dependent. The small opening should be sized based on the viscosity of the flowable substance such that the flowable substance is forced from the bag as opposed to naturally flows from the bag.

Referring to FIGS. 1, 2, and 3, the method of the present invention involves obtaining a bag 30 having two opening 32 and 34, one larger than the other. Obtaining an actuator 10 having a base 12 with a body 16 and a handle 18 wherein the handle 18 has a shape to permit a torque to be applied to the body 16, and an arm 14 hingeably connected to the base 12 wherein the body 16 and the arm 14 cooperate to define a slot 24. The body 16 and the arm 14 also have a clasp 22 for securing the arm 14 relative to the body 16.

A flowable substance 36 is placed in the bag 30 through the larger opening 32. The actuator 10 is attached to the bag 30 at a position adjacent the large opening 32, thereby trapping the flowable substance 36 within the bag 30. The actuator 10 should be placed such that the bag 30 will roll up nicely about the actuator 10, i.e. within the length of the actuator 10. In the case of a conical shaped bag 30, the actuator 10 would be advantageously placed along a circular cross-section.

The actuator 10 is then rotated thereby rolling the bag 30 up about the actuator 10 in the direction of the smaller opening 34. The rolling up of the bag 30 puts pressure on the flowable substance 36 therein, thereby forcing the flowable substance 36 out through the smaller opening 34. As those skilled in the art will appreciate, the order of the steps above is not necessary required. As an example, the actuator 10 could be obtained after the flowable substance 36 is placed in the bag 30; therefore, the order of the steps should not be considered limiting unless required.

Although the present invention has been described in considerable detail with reference to certain preferred versions thereof, other versions are possible. For example, while frustum of cone bags have been shown other shaped bags with two openings are considered within the scope of the invention. As an another example, the preferred embodiment of the slot 24 is described within the Detailed Description as being formed between the body 16 and an arm 14. In alternative embodiments, a slot 24 can be disposed within the body 16, thereby avoiding the use of an arm 14. Therefore, the spirit and scope of the appended claims should not be limited to the description of the preferred version contained herein.

What is claimed is:

1. A method of dispensing mortar comprising the steps of:

providing a mortar bag having a first opening at a first end, a second opening located at a second end, opposite the first end;

providing an actuator having a body defining a slot for receiving a portion of the mortar bag, and a handle attached to the body;

filling the mortar bag by placing a supply of mortar in said bag through the first opening;

placing the actuator on said mortar bag by inserting the first end of the mortar bag in the slot of the actuator, and thereby closing the first opening of the mortar bag; and dispensing the mortar by rotating the handle of the actuator and rolling the mortar bag about the body of the actuator, thereby forcing the mortar through the second opening in the mortar bag.

2. A mortar dispenser comprising:

a mortar bag having a first opening located at a first end, and a second opening located at a second end, opposite the first end;

a mortar bag actuator having a body that includes a slot for receiving a portion of the mortar bag, and a handle attached to the body;

wherein the mortar bag can be rolled up around the body of the actuator, thereby forcing mortar contained in said mortar bag to exit the mortar bag through the second opening therein.

* * * * *

UNITED STATES PATENT AND TRADEMARK OFFICE

CERTIFICATE OF CORRECTION

PATENT NO. : 6,619,506 B2 Page 1 of 1
DATED : September 16, 2003
INVENTOR(S) : Angelo Famiglietti It is certified that error appears in the above-identified patent and that said Letters Patent is hereby corrected as shown below:

Drawings,
Delete drawing sheet 2 consisting of Fig. 3, replace with Fig. shown.

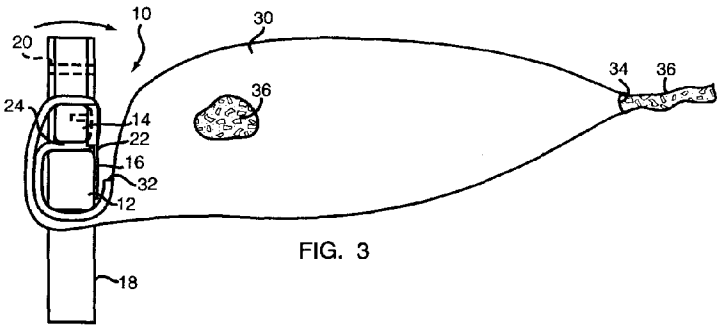

FIG. 3

Signed and Sealed this

Sixth Day of January, 2004

JAMES E. ROGAN
*Director of the United States Patent and Trademark Office*